US012631183B2

(12) United States Patent
Ma et al.

(10) Patent No.: US 12,631,183 B2
(45) Date of Patent: May 19, 2026

(54) COMPRESSOR, AIR CONDITIONING SYSTEM AND AIR CONDITIONER

(71) Applicants: Xiaomi Technology (Wuhan) Co., Ltd., Wuhan (CN); Beijing Xiaomi Mobile Software Co., Ltd., Beijing (CN)

(72) Inventors: Yubo Ma, Wuhan (CN); Lianyu Shan, Wuhan (CN); Junhong Wu, Wuhan (CN); Qingzhuang Wu, Wuhan (CN); Kuanhong Hu, Wuhan (CN)

(73) Assignees: XIAOMI TECHNOLOGY (WUHAN) CO., LTD., Wuhan (CN); BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 18/949,854

(22) Filed: Nov. 15, 2024

(65) Prior Publication Data

US 2025/0320872 A1 Oct. 16, 2025

(30) Foreign Application Priority Data

Apr. 10, 2024 (CN) ..... 202410435299.7

(51) Int. Cl.

| | |
|---|---|
| ***F04C 29/04*** | (2006.01) |
| ***F04C 29/02*** | (2006.01) |
| *F04C 18/32* | (2006.01) |

(52) U.S. Cl.
CPC ..... *F04C 29/04* (2013.01); *F04C 29/02* (2013.01); *F04C 18/322* (2013.01)

(58) Field of Classification Search
CPC ..... F04C 29/04; F04C 29/02; F04C 18/322
See application file for complete search history.

(56) References Cited

U.S. PATENT DOCUMENTS

| | | | | |
|---|---|---|---|---|
| 4,995,792 | A * | 2/1991 | Brown | F04C 29/02 62/505 |
| 11,118,731 | B2 * | 9/2021 | Plow | F16N 39/04 |
| 11,480,178 | B2 * | 10/2022 | Wood | F04C 29/04 |
| 12,163,518 | B2 * | 12/2024 | Wood | F04C 23/001 |

FOREIGN PATENT DOCUMENTS

| | | | |
|---|---|---|---|
| CN | 107476976 | A | 12/2017 |
| JP | 2000130865 | A | 5/2000 |
| WO | 2006060953 | A1 | 6/2006 |
| WO | 2015010260 | A1 | 1/2015 |
| WO | 2020209824 | A1 | 10/2020 |

* cited by examiner

*Primary Examiner* — Jesse S Bogue
(74) *Attorney, Agent, or Firm* — McCoy Russell LLP

(57) ABSTRACT

A compressor, an air conditioning system and an air conditioner. The compressor includes a housing and a heat exchange flow path, where the housing includes a chamber for accommodating a lubricating medium; and the heat exchange flow path is configured to circulate a heat exchange medium to enable the heat exchange medium within the heat exchange flow path to exchange heat with the lubricating medium in the chamber.

20 Claims, 3 Drawing Sheets

COMPRESSOR, AIR CONDITIONING SYSTEM AND AIR CONDITIONER

CROSS REFERENCE TO RELATED APPLICATIONS

The disclosure is proposed on the basis of and claims priority to the Chinese Patent Application No. 202410435299.7, filed on Apr. 10, 2024, and the entire content of which is incorporated herein by reference.

BACKGROUND

A compressor is a device used to pressurize air from low pressure to high pressure, and is used extensively in the field of air conditioning heat pumps. However, lubricating oil inside the compressor is affected by temperature. For example, in winter with low temperature, the viscosity of the lubricating oil is high, and the compressor will encounter problems such as starting difficulty, starting noise and reduced refrigerant circulation accordingly, while in summer with high temperature, the lubricating oil will encounter problems such as carbonization, which affects normal operation of the compressor.

SUMMARY

The disclosure relates to the technical field of compressors, and in particular to a compressor, an air conditioning system and an air conditioner.

In order to achieve the above objective, a first aspect of the disclosure provides a compressor. The compressor includes: a housing including a chamber for accommodating a lubricating medium; and a heat exchange flow path configured to circulate a heat exchange medium, so as to exchange heat with the lubricating medium in the chamber.

A second aspect of the disclosure provides an air conditioning system. The air conditioning system includes a condenser, an evaporator, a throttle and a compressor;

- the compressor includes: a housing including a chamber for accommodating a lubricating medium; and a heat exchange flow path configured to circulate a heat exchange medium, so as to exchange heat with the lubricating medium in the chamber;
- the heat exchange flow path is in communication between an outlet of the condenser and an inlet of the throttle, an outlet of the throttle is in communication with an air inlet of the compressor through the evaporator, and an air outlet of the compressor is in communication with an inlet of the condenser.

A third aspect of the disclosure provides an air conditioner. The air conditioner includes an air conditioning system;

- the air conditioning system includes a condenser, an evaporator, a throttle and a compressor;
- the compressor includes: a housing including a chamber for accommodating a lubricating medium; and a heat exchange flow path configured to circulate a heat exchange medium, so as to exchange heat with the lubricating medium in the chamber;
- the heat exchange flow path is in communication between an outlet of the condenser and an inlet of the throttle, an outlet of the throttle is in communication with an air inlet of the compressor through the evaporator, and an air outlet of the compressor is in communication with an inlet of the condenser.

Other features and advantages of the disclosure will be described in detail in the following detailed embodiments.

BRIEF DESCRIPTION OF DRAWINGS

The drawings, which are used for providing further understanding of the disclosure and constitute part of the description, serve to explain the disclosure along with the following detailed description, instead of limiting the disclosure. In the figures.

DETAILED DESCRIPTION

Figure 1:
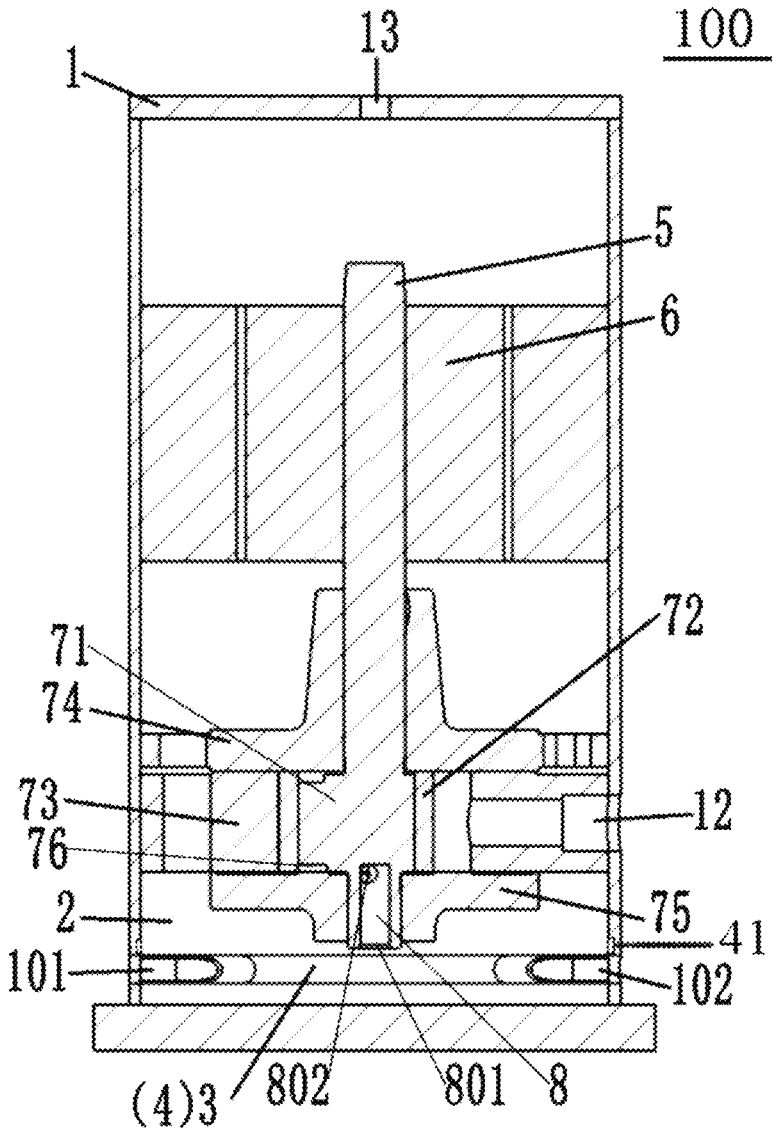
FIG. 1 is an internal sectional view of a compressor according to an example of the disclosure.

Specific embodiments of the disclosure are described in detail below in combination with the drawings. It should be understood that the specific embodiments described here is merely used to describe and explain the disclosure and are not intended to limit the disclosure.

In the disclosure, unless otherwise stated, directional words such as "inner" and "outer" are used to mean "inner" and "outer" relative to a contour of a corresponding component. Moreover, terms used in the disclosure such as "first", "second", etc. are to distinguish one element from another", and do not indicate sequence and importance. Furthermore, when the following description relates to the drawings, the same reference numerals in different drawings indicate the same or similar elements unless otherwise explained. The above definitions are for explanation and description of the disclosure only and should not be construed as limitations on the disclosure.

An objective of the disclosure is to provide a compressor 100, an air conditioning system 1000 and an air conditioner, so as to adjust a temperature of lubricating oil to at least partially solve the above technical problems.

A compressor 100 and an air conditioning system 1000 in illustrative examples of the disclosure will be described below in conjunction with the accompanying drawings.

With reference to FIG. 1 to FIG. 4, a first aspect of the disclosure provides a compressor 100. The compressor 100 includes a housing 1 and a heat exchange flow path 3. The housing 1 includes a chamber 2 for accommodating a lubricating medium. The heat exchange flow path 3 is configured to circulate a heat exchange medium, so as to exchange heat with the lubricating medium in the chamber 2. When a temperature of the lubricating medium is too high or too low, the heat exchange medium may directly or indirectly exchange heat with the lubricating medium through the heat exchange flow path 3, so as to cool the lubricating medium when the temperature of the lubricating medium is too high, and heat the lubricating medium when the temperature of the lubricating medium is too low. Thus it is guaranteed that the temperature of the lubricating medium can be maintained in a proper temperature range, and an influence on operation of the compressor 100 caused by a too high or low temperature of the lubricating medium can be reduced or even avoided.

The lubricating medium of the disclosure may be lubricating oil, and the heat exchange medium may be a refrigerant.

Moreover, the compressor 100 may be, for example, a rolling-rotor compressor or a different type of compressor.

Figure 3:
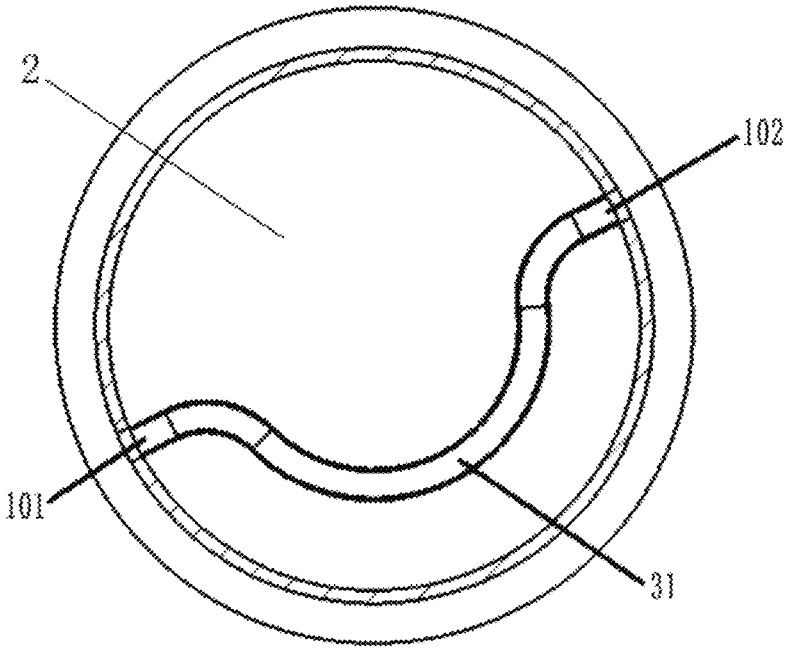
FIG. 3 is a top view of a chamber according to an example of the disclosure.

In some embodiments of the disclosure, as shown in FIGS. 1 and 3, the heat exchange flow path 3 may include a heat exchange tube 4. At least part of the heat exchange tube 4 is arranged in the chamber 2. The heat exchange tube 4 arranged in the chamber 2 may make direct contact with the lubricating medium, such that the heat exchange medium located in the heat exchange tube 4 exchanges heat with the lubricating medium. Certainly, since the lubricating medium gathers at a bottom of the chamber 2 first, in order to increase a contact area between the heat exchange tube 4 and the lubricating medium, the heat exchange tube 4 may be arranged close to a bottom wall of the chamber 2 or attached to a bottom wall of the chamber 2, such that the lubricating medium makes contact with an outer wall of the heat exchange tube 4 as much as possible, or even the heat exchange tube 4 is immersed in the lubricating medium, such that the heat exchange medium and the lubricating medium can perform sufficient heat exchange to improve heat exchange efficiency. Alternatively, the heat exchange tube 4 may be spaced from the lubricating medium, that is, the heat exchange medium in the heat exchange tube 4 exchanges heat with the chamber 2, and the temperature of the lubricating medium in the chamber 2 is adjusted by adjusting a temperature in the chamber 2; and/or the heat exchange flow path 3 may further include a heat exchange flow passage 41, the heat exchange flow passage 41 is formed on the housing 1, that is, the heat exchange medium in the heat exchange flow passage 41 may be arranged between an inner wall and an outer wall of the housing 1, the heat exchange medium first exchanges heat with the housing 1, and then the housing 1 after heat exchange adjusts the temperature of the lubricating medium in the chamber 2.

Moreover, heights of the heat exchange tube 4 and the heat exchange flow passage 41 relative to a bottom surface of the chamber 2 may be less than a depth of the lubricating medium in the chamber 2, such that the lubricating medium can immerse the heat exchange tube 4 or make contact with the inner wall of the housing 1 as much as possible, so as to increase a heat exchange area and improve a heat exchange effect.

In some embodiments, as shown in FIG. 3, the heat exchange tube 4 and/or the heat exchange flow passage 41 include/includes a curved flow section 31. The curved flow section 31 of the heat exchange tube 4 is located in the chamber 2. The curved flow section 31 may increase a length of the heat exchange tube 4 and/or the heat exchange flow passage 41 arranged in the chamber 2 in a limited space, such that an effect of increasing the heat exchange area of the heat exchange tube 4 and/or the heat exchange flow passage 41 relative to the lubricating medium is achieved, and the heat exchange efficiency is improved.

Furthermore, a plurality of heat exchange tubes 4 and/or heat exchange flow passages 41 may be provided. For example, the plurality of heat exchange tubes 4 may be spaced in the chamber 2, and alternatively, one heat exchange tube 4 located in the chamber 2 may be provided with a plurality of spaced branch tubes. Similarly, the plurality of heat exchange flow passages 41 may be annularly spaced on the housing 1. The heat exchange tubes 4 and/or heat exchange flow passages 41 arranged in such a manner may also increase the heat exchange area between the heat exchange medium and the lubricating medium, so as to further improve the heat exchange efficiency between the heat exchange medium and the lubricating medium.

In some embodiments of the disclosure, as shown in FIGS. 1 and 3, the housing 1 is provided with a heat exchange medium inlet 101 and a heat exchange medium outlet 102. The heat exchange tube 4 and/or the heat exchange flow passage 41 are/is in communication between the heat exchange medium inlet 101 and the heat exchange medium outlet 102. The heat exchange medium inlet 101 is configured to be in communication with an outlet of a condenser 9, and the heat exchange medium outlet 102 is in communication with a throttle 11. That is to say, a liquid-phase refrigerant discharged from the condenser 9 serves as the heat exchange medium to exchange heat with the lubricating medium. Compared with a heat exchange medium in a gaseous state, the heat exchange medium in a liquid phase occupies less space and has a better heat exchange effect at a same flow rate, that is, the heat exchange efficiency can be improved when a space occupied by the heat exchange tube 4 and/or the heat exchange flow passage 41 is reduced. Moreover, the refrigerant serves as the heat exchange medium, such that it is unnecessary to separately arrange a heat exchange apparatus to provide a heat exchange medium. Cost required for the heat exchange system is reduced, and the economical efficiency is guaranteed.

The throttle 11 may be an expansion valve or a capillary tube.

Certainly, in some embodiments not shown in the figures, the heat exchange medium inlet 101 and the heat exchange medium outlet 102 may also be connected to a heat exchange apparatus separately. For example, the heat exchange apparatus may be a heat exchange water tank, and the heat exchange medium is heat exchange water in the heat exchange water tank. The heat exchange medium inlet 101 is connected to an outlet of the heat exchange water tank, and the heat exchange medium outlet 102 is connected to an inlet of the heat exchange water tank. The heat exchange water tank may adjust a temperature of the heat exchange water and circulate the heat exchange water between the heat exchange water tank and the heat exchange tube 4 and/or the heat exchange flow passage 41, so as to guarantee that the heat exchange water may exchange heat with the lubricating medium.

Figure 4:
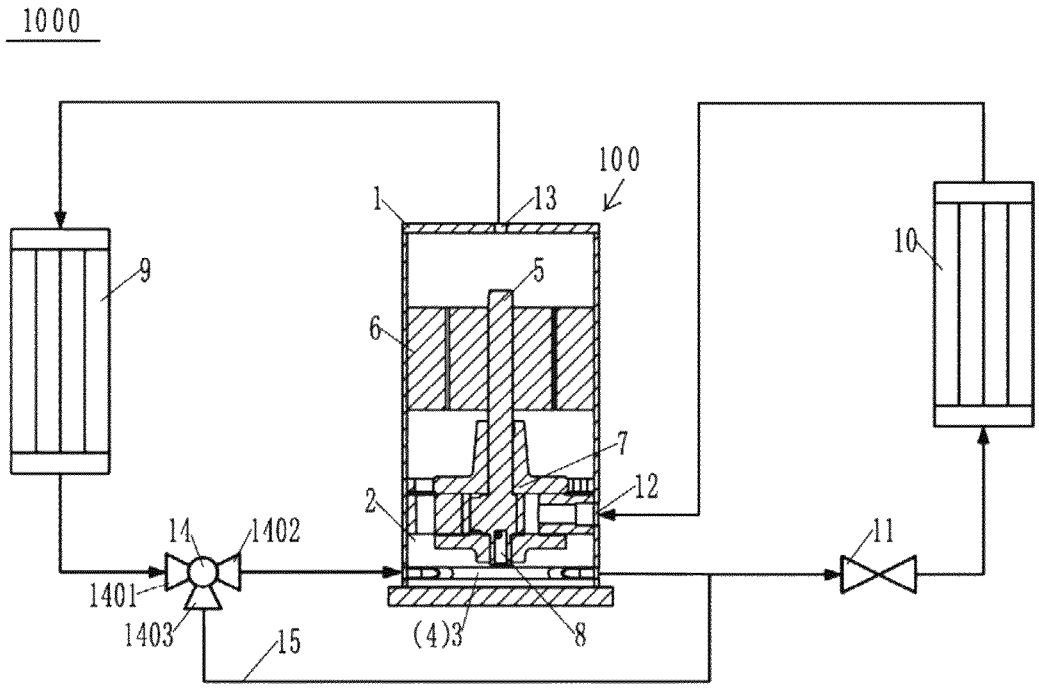
FIG. 4 is a schematic diagram of an air conditioning system according to an example of the disclosure.

In some embodiments of the disclosure, as shown in FIGS. 1 and 4, the compressor further includes a compression mechanism arranged in the housing 1. The compression mechanism is configured to suck and compress the heat exchange medium flowing through the throttle 11 and an evaporator 10 from the heat exchange medium outlet 102 of the heat exchange flow path 3. That is, after the heat exchange medium exchanges heat with the lubricating medium, the throttle 11 converts the high-pressure liquid-phase heat exchange medium into a low-pressure liquid-phase heat exchange medium and adjusts a flow rate of the heat exchange medium entering the evaporator 10, to satisfy a refrigeration demand of the evaporator 10. Then a gas-phase heat exchange medium discharged from the evaporator 10 is sucked and compressed by the compression mechanism.

The compression mechanism includes a rotating shaft 5, a drive assembly 6 and a compression assembly 7. The drive assembly 6 and the compression assembly 7 are arranged on the rotating shaft 5 at an interval in an axial direction of the rotating shaft 5, the chamber 2 is located at a side of the compression assembly 7 facing away from the drive assembly 6, and alternatively, the chamber 2 is located at a side of the compression assembly 7 facing the drive assembly 6. The drive assembly 6 may drive the rotating shaft 5 to rotate, such that the rotating shaft 5 drives the compression assembly 7 to operate, and then the gas-phase heat exchange medium discharged from the evaporator 10 is sucked and compressed. It should be noted that when the chamber 2 is located at the side of the compression assembly 7 facing away from the drive assembly 6, the chamber 2 is closer to the bottom of the housing 1, such that replacement of the lubricating medium in the chamber 2 and arrangement of the heat exchange flow path 3 are convenient.

Specifically, the drive assembly 6 may include a motor stator arranged on the inner wall of the housing 1 and a motor rotor arranged on the rotating shaft 5, such that the rotating shaft 5 is driven to rotate by cooperation of the motor stator and the motor rotor. The compression assembly 7 may include an eccentric wheel 71 and a rotor 72. The eccentric wheel 71 is fixed on the rotating shaft 5. The rotor 72 sleeves the eccentric wheel 71. A lubricating cavity 76 is arranged between the eccentric wheel 71 and the rotor 72. The chamber 2 is in communication with the lubricating cavity 76 through a flow passage 8, such that the lubricating medium flows into the lubricating cavity 76. When the rotating shaft 5 drives the eccentric wheel 71 to rotate, the lubricating medium in the chamber 2 flows into the lubricating cavity 76 along the flow passage 8. In this way, not only friction between components in the compression assembly 7 can be reduced to guarantee the lubricating effect, but also a sealing effect is achieved to guarantee normal operation of the compressor 100.

Figure 2:
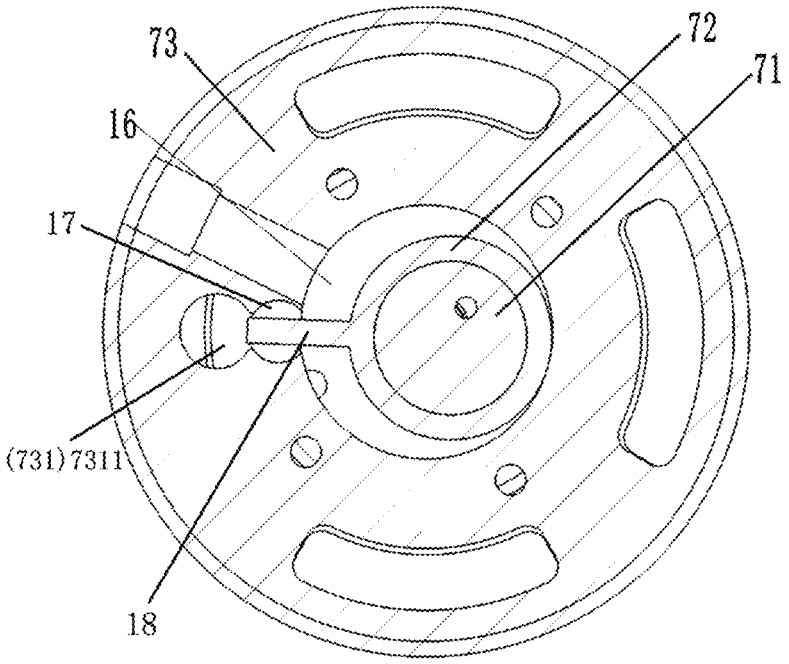
FIG. 2 is a top view of a compression assembly according to an example of the disclosure.

In some embodiments, as shown in FIGS. 1 and 2, the compression assembly 7 further includes an air cylinder 73, a first end cover 74 and a second end cover 75. The first end cover 74 and the second end cover 75 are located at two sides of the air cylinder 73 in the axial direction of the rotating shaft 5 respectively. The rotor 72 and the eccentric wheel 71 are located in an inner cavity 16 defined by the first end cover 74, the second end cover 75 and the air cylinder 73. The rotating shaft 5 sequentially penetrates the first end cover 74, the inner cavity 16 and the second end cover 75 from the drive assembly 6. The chamber 2 is located at a side of the air cylinder 73 facing away from the drive assembly 6. The flow passage 8 is formed on the rotating shaft 5 and has a first opening 801 in communication with the chamber 2 and a second opening 802 in communication with the lubricating cavity 76. Moreover, the air cylinder 73 is further provided with an avoidance groove 731. The avoidance groove 731 includes two arc holes 7311 arranged adjacent and in communication with each other in a radial direction of the air cylinder 73. The arc hole 7311 close to a side of the inner cavity 16 may also be in communication with the inner cavity 16, and an inner wall of the arc hole 7311 close to a side of the inner cavity 16 is further provided with a slide block 17 rotatably connected to the inner wall. The rotor 72 is provided with a stop rod 18 capable of being inserted into the slide block 17 and sliding in the slide block 17. When the compressor 100 is working, the motor rotor is started, and the rotating shaft 5 rotates together with the motor rotor to drive the eccentric wheel 71 to rotate, so as to drive the rotor 72 to roll in the inner cavity 16. In this case, the stop rod 18 slides back and forth in the slide block 17 and oscillates at a certain angle relative to the inner cavity 16. Specifically, the eccentric wheel 71 rotates synchronously with the rotating shaft 5, the rotor 72 may roll along an inner peripheral wall of the inner cavity 16, and then a crescent space has a volume periodically changed, such that air is sucked through an air inlet 12 of the compressor in communication with the inner cavity 16, then compressed, and discharged through an air outlet 13 of the compressor in communication with the inner cavity 16, and further the heat exchange medium discharged from the evaporator 10 is sucked, compressed and discharged. Correspondingly, the lubricating medium in the chamber 2 may immerse the first opening 801, such that the lubricating medium may enter the flow passage 8 from the first opening 801 and be discharged from the second opening 802 along the flow passage 8 under the action of centrifugal force while the rotating shaft 5 rotates, such that the compression assembly 7 is lubricated. Reference may be made for an operation principle of the compression mechanism to a compression principle of a rolling-rotor compressor, which is not repeated here.

The stop rod 18 and the rotor 72 may be of an integrated structure or a separate structure, which is not limited here.

Further, the air inlet 12 may be arranged on a side wall of the housing 1 to be in communication with the inner cavity 16. When the chamber 2 is located on a side of the air cylinder 73 facing away from the drive assembly 6, for example, below the air cylinder 73 shown in FIG. 1, the air outlet 13 may be located on a side of the air cylinder 73 facing away from the chamber 2, for example, above the air cylinder 73 shown in FIG. 1, for example, at a top of the housing 1, in order to prevent the lubricating medium from influencing an air discharge process. Accordingly, in the embodiments not shown in the figures, the chamber 2 may be located at a side of the air cylinder 73 facing the drive assembly 6, and the air outlet 13 may be located at a side of the air cylinder 73 facing away from the drive assembly 6, which are not limited here.

As shown in FIG. 4, a second aspect of the disclosure provides an air conditioning system 1000. The air conditioning system 1000 includes a condenser 9, an evaporator 10, a throttle 11 and the compressor 100. A heat exchange flow path 3 is in communication between an outlet of the condenser 9 and an inlet of the throttle 11. An outlet of the throttle 11 is in communication with an air inlet 12 of the compressor through the evaporator 10. An air outlet 13 of the compressor is in communication with an inlet of the condenser 9. The liquid-phase heat exchange medium in the condenser 9 first enters the heat exchange flow path 3 to exchange heat with the lubricating medium in the chamber 2, such that the lubricating medium is at a suitable temperature to guarantee normal operation of the compressor 100. Then the liquid-phase heat exchange medium enters the evaporator 10 through the throttle 11 and is converted into a gas-phase heat exchange medium. The gas-phase heat exchange medium enters the compressor 100 from the air inlet 12, is compressed by the compressor 100, is discharged through the air outlet 13, and finally returns to the condenser 9 again, such that one refrigeration cycle of the heat exchange medium is completed. Furthermore, the air conditioning system 1000 has all the beneficial effects of the compressor 100, which are not repeated here.

In some embodiments of the disclosure, as shown in FIG. 4, the air conditioning system 1000 further includes a three-way valve 14. An inlet 1401 of the three-way valve 14 is in communication with the outlet of the condenser 9. A first outlet 1402 of the three-way valve 14 is in communication with the inlet of the throttle 11 through the heat exchange flow path 3. A second outlet 1403 of the three-way valve 14 is in communication with the inlet of the throttle 11 through a bypass tube 15. Only one of the first outlet 1402 and the second outlet 1403 of the three-way valve 14 may be opened at a same time period. For example, under normal conditions, there is no need to adjust the temperature of the heat exchange medium in the compressor 100. In this case, the first outlet 1402 is closed, the second outlet 1403 is opened, and the liquid-phase heat exchange medium from the condenser 9 directly enters the evaporator 10 through the bypass tube 15. Under extreme conditions, for example, when the temperature of the lubricating medium is too high or too low, and it is necessary to adjust the temperature of the lubricating medium, the first outlet 1402 is opened, and the second outlet 1403 is closed, such that the heat exchange medium from the condenser 9 may exchange heat with the lubricating medium in the chamber 2 through the heat exchange flow path 3, such that the lubricating medium is at a proper temperature to guarantee the normal operation of the compressor 100.

The three-way valve 14 may be in signal connection to a controller. The controller may be in signal connection to, for example, an ambient temperature sensor to control switching of the first outlet 1402 and the second outlet 1403 of the three-way valve 14 by measuring an ambient temperature.

A third aspect of the disclosure provides an air conditioner. The air conditioner includes the air conditioning system 1000. The air conditioner has all the beneficial effects of the air conditioning system 1000, which are not repeated here.

In summary, the disclosure illustratively shows a use process of the air conditioning system 1000 when a compressor 100 exchanges heat with a lubricating medium.

Under normal conditions, a liquid-phase heat exchange medium, that is, a liquid-phase refrigerant, in a condenser 9 directly passes through a bypass tube 15 and a throttle 11 through a second outlet 1403 of a three-way valve 14 to enter an evaporator 10 and is converted into a gas-phase refrigerant. The gas-phase refrigerant enters the compressor 100 from an air inlet 12 of the compressor 100, is compressed inside the compressor, is discharged from an air outlet 13, and finally returns to the condenser 9 to complete one refrigeration cycle. Under extreme conditions, a temperature of the lubricating medium, that is, lubricating oil, in the compressor 100 is in a higher or lower state. Thus, in order to adjust the temperature of the lubricating oil to a normal temperature range, the liquid-phase refrigerant discharged from the condenser 9 enters a heat exchange flow path 3 through a first outlet 1402 of the three-way valve 14 to exchange heat with the lubricating oil and adjust the temperature of the lubricating oil. It should be noted that a curved flow section 31 of the heat exchange flow path 3 may increase a heat exchange area between the refrigerant and the lubricating oil and improve a heat exchange effect. Since density of the liquid-phase refrigerant is greater than that of a gas-phase refrigerant, a space occupied by the liquid-phase refrigerant is less at a same flow rate, such that a size of the heat exchange flow path 3 is reduced, a space is saved, and the heat exchange efficiency is guaranteed. The liquid-phase refrigerant after heat exchange enters the evaporator 10, is converted into a gas-phase refrigerant and then is discharged from the evaporator 10. The gas-phase refrigerant discharged from the evaporator 10 is compressed by the compressor 100 and discharged, and finally returns to the condenser 9 to complete one refrigeration cycle. According to the housing 1 in the disclosure, the heat exchange flow path 3 is arranged, such that the heat exchange medium circulated in the heat exchange flow path 3 can exchange heat with the lubricating medium in the chamber 2. Thus a temperature of the lubricating medium is adjusted and maintained in a proper temperature range, and an influence on operation of the compressor 100 caused by a too high or low temperature of the lubricating medium is reduced or even avoided.

The preferred embodiments of the disclosure are described in detail above with reference to the drawings. However, the disclosure is not limited to specific details of the above embodiments. Within the scope of the technical concept of the disclosure, various simple modifications may be made to the technical solutions of the disclosure, and these simple modifications all fall within the scope of protection of the disclosure.

It should also be noted that various specific technical features described in the above specific embodiments may be combined in any suitable manner without contradiction. In order to avoid unnecessary repetition, the disclosure will not describe various possible combinations separately.

Moreover, various different embodiments of the disclosure may also be combined randomly so long as they do not deviate from the idea of the disclosure, and should also be regarded as contents disclosed in the disclosure.

EMBODIMENTS

A first embodiment provides a compressor. The compressor includes: a housing including a chamber for accommodating a lubricating medium; and a heat exchange flow path configured to circulate a heat exchange medium, so as to exchange heat with the lubricating medium in the chamber.

A second embodiment includes a compressor of the first embodiment, the heat exchange flow path includes a heat exchange tube, and at least part of the heat exchange tube is arranged in the chamber; and/or the heat exchange flow path include/includes a heat exchange flow passage, and the heat exchange flow passage is formed on the housing.

A third embodiment includes a compressor of the second embodiment, the heat exchange tube and/or the heat exchange flow passage include/includes a curved flow section, and the curved flow section of the heat exchange tube is located in the chamber.

A fourth embodiment includes a compressor of the second embodiment, the housing is provided with a heat exchange medium inlet and a heat exchange medium outlet, the heat exchange tube and/or the heat exchange flow passage are/is in communication between the heat exchange medium inlet and the heat exchange medium outlet, the heat exchange medium inlet is configured to be in communication with an outlet of a condenser, and the heat exchange medium outlet is configured to be in communication with a throttle.

A fifth embodiment includes a compressor according to any one of the first embodiment to the fourth embodiment, the compressor further includes a compression mechanism arranged in the housing, where the compression mechanism is configured to suck and compress the heat exchange medium flowing through the throttle and an evaporator from the heat exchange medium outlet of the heat exchange flow path.

A sixth embodiment includes a compressor of the fifth embodiment, the compression mechanism includes a rotating shaft, a drive assembly and a compression assembly, the drive assembly and the compression assembly are arranged on the rotating shaft at an interval in an axial direction of the rotating shaft, the chamber is located at a side of the compression assembly facing away from the drive assembly, and alternatively, the chamber is located at a side of the compression assembly facing the drive assembly.

A seventh embodiment includes a compressor of the sixth embodiment, the compression assembly includes an eccentric wheel and a rotor, the eccentric wheel is fixed on the rotating shaft, the rotor sleeves the eccentric wheel, a lubricating cavity is arranged between the eccentric wheel and the rotor, and the chamber is in communication with the lubricating cavity through a flow passage, such that the lubricating medium flows into the lubricating cavity.

A eighth embodiment includes a compressor of the seventh embodiment, the compression assembly further includes an air cylinder, a first end cover and a second end cover, the first end cover and the second end cover are located at two sides of the air cylinder in the axial direction of the rotating shaft respectively, the rotor and the eccentric wheel are located in an inner cavity defined by the first end cover, the second end cover and the air cylinder, the rotating shaft sequentially penetrates the first end cover, the inner cavity and the second end cover from the drive assembly, the chamber is located at a side of the air cylinder facing away from the drive assembly, and the flow passage is formed on the rotating shaft and has a first opening in communication with the chamber and a second opening in communication with the lubricating cavity.

A ninth embodiment provides an air conditioning system. The air conditioning system includes a condenser, an evaporator, a throttle and the compressor as described above, where a heat exchange flow path is in communication between an outlet of the condenser and an inlet of the throttle, an outlet of the throttle is in communication with an air inlet of the compressor through the evaporator, and an air outlet of the compressor is in communication with an inlet of the condenser.

A tenth embodiment includes an air conditioning system of the ninth embodiment, the air conditioning system further includes a three-way valve, where an inlet of the three-way valve is in communication with the outlet of the condenser, a first outlet of the three-way valve is in communication with the inlet of the throttle through the heat exchange flow path, and a second outlet of the three-way valve is in communication with the inlet of the throttle through a bypass tube.

An eleventh embodiment provides an air conditioner. The air conditioner includes the air conditioning system as described above.

The invention claimed is:

1. A compressor, comprising:

a housing comprising a chamber for accommodating a lubricating medium; and a heat exchange flow path being configured to circulate a heat exchange medium to exchange heat with the lubricating medium in the chamber, wherein the housing comprises a heat exchange medium inlet and a heat exchange medium outlet, the heat exchange path is in communication between the heat exchange medium inlet and the heat exchange medium outlet, the heat exchange medium inlet is configured to be in communication with an outlet of a condenser, and the heat exchange medium outlet is in communication with a throttle.

2. The compressor according to claim 1, wherein the heat exchange flow path comprises a heat exchange tube, and at least part of the heat exchange tube is arranged in the chamber.

3. The compressor according to claim 1, wherein the heat exchange flow path comprises a heat exchange flow passage, and the heat exchange flow passage is formed on the housing.

4. The compressor according to claim 1, wherein the heat exchange flow path comprises a heat exchange tube, and at least part of the heat exchange tube is arranged in the chamber; and the heat exchange flow path comprises a heat exchange flow passage, and the heat exchange flow passage is formed on the housing.

5. The compressor according to claim 2, wherein the heat exchange tube comprises a curved flow section, and the curved flow section of the heat exchange tube is located in the chamber.

6. The compressor according to claim 3, wherein the heat exchange flow passage comprises a curved flow section.

7. The compressor according to claim 4, wherein the heat exchange tube and the heat exchange flow passage comprise at least one curved flow section respectively, and the curved flow section of the heat exchange tube is located in the chamber.

8. The compressor according to claim 2, wherein the heat exchange tube is in communication between the heat exchange medium inlet and the heat exchange medium outlet, the heat exchange medium inlet is configured to be in communication with the outlet of a condenser, and the heat exchange medium outlet is in communication with the throttle.

9. The compressor according to claim 3, wherein the heat exchange flow passage is in communication between the heat exchange medium inlet and the heat exchange medium outlet, the heat exchange medium inlet is configured to be in communication with the outlet of a condenser, and the heat exchange medium outlet is in communication with the throttle.

10. The compressor according to claim 4, wherein at least one of the heat exchange tube and the heat exchange flow passage is in communication between the heat exchange medium inlet and the heat exchange medium outlet, the heat exchange medium inlet is configured to be in communication with the outlet of a condenser, and the heat exchange medium outlet is in communication with the throttle.

11. The compressor according to claim 10, wherein the compressor further comprises a compression mechanism arranged in the housing, and the compression mechanism is configured to suck and compress the heat exchange medium flowing through the throttle and an evaporator from the heat exchange medium outlet of the heat exchange flow path.

12. The compressor according to claim 11, wherein the compression mechanism comprises a rotating shaft, a drive assembly and a compression assembly, the drive assembly and the compression assembly are arranged on the rotating shaft at an interval in an axial direction of the rotating shaft, and the chamber is located either at a side of the compression assembly facing away from the drive assembly or at a side of the compression assembly facing the drive assembly.

13. The compressor according to claim 12, wherein the compression assembly comprises an eccentric wheel and a rotor, the eccentric wheel is fixed on the rotating shaft, the rotor sleeves the eccentric wheel, a lubricating cavity is arranged between the eccentric wheel and the rotor, and the chamber is in communication with the lubricating cavity through a flow passage, such that the lubricating medium flows into the lubricating cavity.

14. The compressor according to claim 13, wherein the compression assembly further comprises an air cylinder, a first end cover and a second end cover, the first end cover and the second end cover are located at two sides of the air cylinder in the axial direction of the rotating shaft respectively, the rotor and the eccentric wheel are located in an inner cavity defined by the first end cover, the second end cover and the air cylinder, the rotating shaft sequentially penetrates the first end cover, the inner cavity and the second end cover from the drive assembly, the chamber is located at a side of the air cylinder facing away from the drive assembly, and the flow passage is formed on the rotating shaft and has a first opening in communication with the chamber and a second opening in communication with the lubricating cavity.

15. An air conditioning system, comprising a condenser, an evaporator, a throttle and a compressor;

the compressor comprising:

a housing comprising a chamber for accommodating a lubricating medium; and a heat exchange flow path being configured to circulate a heat exchange medium, so as to exchange heat with the lubricating medium in the chamber;

the heat exchange flow path being in communication between an outlet of the condenser and an inlet of the throttle, an outlet of the throttle being in communication with an air inlet of the compressor through the evaporator, and an air outlet of the compressor being in communication with an inlet of the condenser.

16. The air conditioning system according to claim 15, wherein the air conditioning system further comprises a three-way valve, an inlet of the three-way valve is in communication with the outlet of the condenser, a first outlet of the three-way valve is in communication with the inlet of the throttle through the heat exchange flow path, and a second outlet of the three-way valve is in communication with the inlet of the throttle through a bypass tube.

17. The air conditioning system according to claim 15, wherein the heat exchange flow path comprises at least one of a heat exchange tube and a heat exchange flow passage;

at least part of the heat exchange tube is arranged in the chamber; and the heat exchange flow passage is formed on the housing.

18. The air conditioning system according to claim 17, wherein the heat exchange tube comprises a curved flow section, and the curved flow section of the heat exchange tube is located in the chamber.

19. An air conditioner, comprising an air conditioning system;

the air conditioning system, comprising a condenser, an evaporator, a throttle and a compressor;

the compressor comprising:

a housing comprising a chamber for accommodating a lubricating medium; and a heat exchange flow path being configured to circulate a heat exchange medium, so as to exchange heat with the lubricating medium in the chamber;

the heat exchange flow path being in communication between an outlet of the condenser and an inlet of the throttle, an outlet of the throttle being in communication with an air inlet of the compressor through the evaporator, and an air outlet of the compressor being in communication with an inlet of the condenser.

20. The air conditioner according to claim 19, wherein the air conditioning system further comprises a three-way valve, an inlet of the three-way valve is in communication with the outlet of the condenser, a first outlet of the three-way valve is in communication with the inlet of the throttle through the heat exchange flow path, and a second outlet of the three-way valve is in communication with the inlet of the throttle through a bypass tube.

* * * * *